US007260964B2

(12) United States Patent
Velicanin et al.

(10) Patent No.: US 7,260,964 B2
(45) Date of Patent: Aug. 28, 2007

(54) ACTUATING DEVICE FOR DOORS OR HATCHES OF VEHICLES

(75) Inventors: Mensur Velicanin, Velbert (DE); Stefan Mönig, Schwelm (DE)

(73) Assignee: Huf Hülsbeck & Fürts GmbH & Co. KG, Velbert (DE)

( * ) Notice: Subject to any disclaimer, the term of this patent is extended or adjusted under 35 U.S.C. 154(b) by 309 days.

(21) Appl. No.: 11/016,541

(22) Filed: Dec. 17, 2004

(65) Prior Publication Data

US 2006/0277954 A1 Dec. 14, 2006

(30) Foreign Application Priority Data

Dec. 20, 2003 (DE) ..... 103 60 175

(51) Int. Cl.
*E05B 13/10* (2006.01)

(52) U.S. Cl. ..... 70/208; 70/370; 70/451; 292/336.3; 292/DIG. 31

(58) Field of Classification Search ..... 70/208, 70/210, 224, 370, 371, 451, 466; 292/336.3, 292/DIG. 31, DIG. 53; 296/1.02, 152, 146.1
See application file for complete search history.

(56) References Cited

U.S. PATENT DOCUMENTS 2,040,258 A * 5/1936 Jacobi ..... 70/370
6,401,302 B1 * 6/2002 Josserand et al. ..... 292/336.3
6,415,636 B1 * 7/2002 Fukumoto et al. ..... 70/208
6,494,066 B2 * 12/2002 Muneta ..... 70/208
6,523,379 B2 * 2/2003 Teskey ..... 70/371
6,748,775 B1 * 6/2004 Bucker et al. ..... 70/208
6,834,901 B2 * 12/2004 Low ..... 292/336.3
2002/0124606 A1 * 9/2002 Muneta ..... 70/208

FOREIGN PATENT DOCUMENTS

DE 101 51 862 5/2003
EP 1 026 351 8/2000

* cited by examiner

*Primary Examiner*—Suzanne Dino Barrett
*Assistant Examiner*—Christopher Boswell
(74) *Attorney, Agent, or Firm*—Friedrich Kueffner

(57) ABSTRACT

An actuating device for a door or hatch of a vehicle includes a carrier for moving a slide between a locking position and a release position for locking a turret to be inserted into an opening of the carrier in a desired inserted position. The slide is provided on its front side in the pull-out direction with a lobe which includes a radially outer surface pointing away from the inserted turret. The turret has an opposing lobe facing the insertion direction, wherein the opposing lobe is arranged at a radial distance from the adjacent circumferential zone of the turret and includes a radially inner surface facing the turret. When the turret is moved into the locking position, the lobe travels into a radial distance from the slide and is moved behind the opposing lobe where the lobe rests with its radially outer surface on the radially inner surface of the opposing lobe.

29 Claims, 5 Drawing Sheets

ACTUATING DEVICE FOR DOORS OR HATCHES OF VEHICLES

BACKGROUND OF THE INVENTION

1. Field of the Invention

The present invention relates to an actuating device for doors or hatches of vehicles. Such a device also includes a so-called "turret", which can hold either a real lock cylinder or a dummy cylinder for the sake of styling. A turret of this type is usually inserted from the outside of the door into an opening in the carrier, where it is then locked in place by a slide, guided movably on the carrier, only after the carrier has been attached to the interior of the door. The slide has a shoulder, and the carrier has an opposing shoulder. When the slide is in a certain position, the two shoulders line up with each other, and this therefore defines the "locking position". When the slide is pushed into a "release position", the shoulder releases the opposing shoulder, and the turret can be inserted into the carrier or pulled back out of it again.

2. Description of the Related Art

In the known actuating device of this type (EP 1 026 351 A1), part of the plate-shaped slide is cut away, as a result of which the slide acquires the shape of a "U". The sidepieces of this U-shaped slide can slide along the lateral guide rails on the carrier. On the web which connects the two sidepieces of the U, a threaded hole is provided for an adjusting screw, the head of which points toward the interior of the yoke, whereas the actuating end which serves to actuate the screw projects laterally from the carrier. This actuating end of the adjusting screw can be actuated through a lateral opening in the rabbet area of the door. When the adjusting screw is actuated, the head of the screw meets a side wall of the turret, which has been inserted into an opening in the carrier, and as it is screwed in further, it moves the U-shaped slide toward the door rabbet. Projections seated on the end of the two sidepieces of the "U" travel into corresponding openings in the turret, the goal of which is to make it impossible to pull the turret out of the carrier. The pull-out resistance of the turret provided by clamping the turret between the projections of the U-shaped slide and the head of the adjusting screw is unsatisfactory.

SUMMARY OF THE INVENTION

The invention is based on the task of developing an actuating device of the type described above which is characterized by a turret with greater resistance to being pulled out of the carrier.

In accordance with the present invention the slide of the actuating device has a lobe, which points in the pull-out direction of the turret. When the slide is in the locking position, the radially outer surface of this lobe comes to rest against the radially inner surface of an opposing lobe on the turret. This opposing lobe points in the insertion direction of the turret and is a certain radial distance away from an adjacent circumferential surface of the turret. When the lobe moves into the locking position, it travels into the radial gap of the turret and thus arrives in front of the turret's opposing lobe. When an unauthorized person wants to gain access to the interior of the vehicle, he will attempt to tear out by force the turret from the carrier in the axial direction, the direction in which this force is exerted being called the pull-out direction. Under this pull-out force, the opposing shoulders press against the shoulders of the slide. As a result, the plate-shaped slide is subjected to a bending moment, which tries to bend the slide outward. The invention resists this bending moment, because the bending forces acting on the slide are transmitted from the radially outer surface of its lobe to the radially inner surface of the opposing lobe of the turret and are absorbed by the turret. The slide therefore does not bend upward in the area of the turret's shoulder. The carrier of the device is therefore able to withstand high pull-out forces.

Providing a lobe on the slide and an opposing lobe on the turret requires only a small amount of material, and the lobes occupy only a small amount of space. The high pull-out resistance is obtained without the use of expensive, high-strength materials and without the need for very thick material in the slide and the carrier, which would thus become bulky. Normally, the slide is designed in the form of a plate. To increase the pull-out resistance, a thickened area can be provided near the shoulder which arrives in front of the opposing shoulder on the turret when the device is in the locking position. The plate can easily be provided with a thickened area of this type by the use of a block, which is mounted on the rear surface of the plate-shaped carrier.

It is advisable to provide a radial projection on the turret which has an axial heel pointing toward the circumferential zone with the opposing lobe. This axial heel functions as an opposing shoulder, which cooperates in the locking position with the shoulder on the slide.

The slide can be shifted automatically by the insertion of the turret into the opening and/or by the removal of the turret from the opening in the carrier. For this purpose it is sufficient to provide control surfaces on the turret which slant in the insertion direction and actuating surfaces on the slide, which slant in the opposite direction. Thus, when the turret is inserted, the control surfaces on it can meet the actuating surfaces on the slide and push it back, for example, out of the locking position into the release position. It is advisable to provide these control surfaces on the radial projection of the turret, whereas the actuating surfaces should be on the lobe and/or on the block of the slide. This automatic return movement of the slide is appropriate especially in cases where the slide is subjected to the force of a spring, which tries to move it into, for example, the locking position.

While specific embodiments of the invention have been shown and described in detail to illustrate the inventive principles, it will be understood that the invention may be embodied otherwise without departing from such principles.

DETAILED DESCRIPTION OF THE INVENTION

Figure 1:
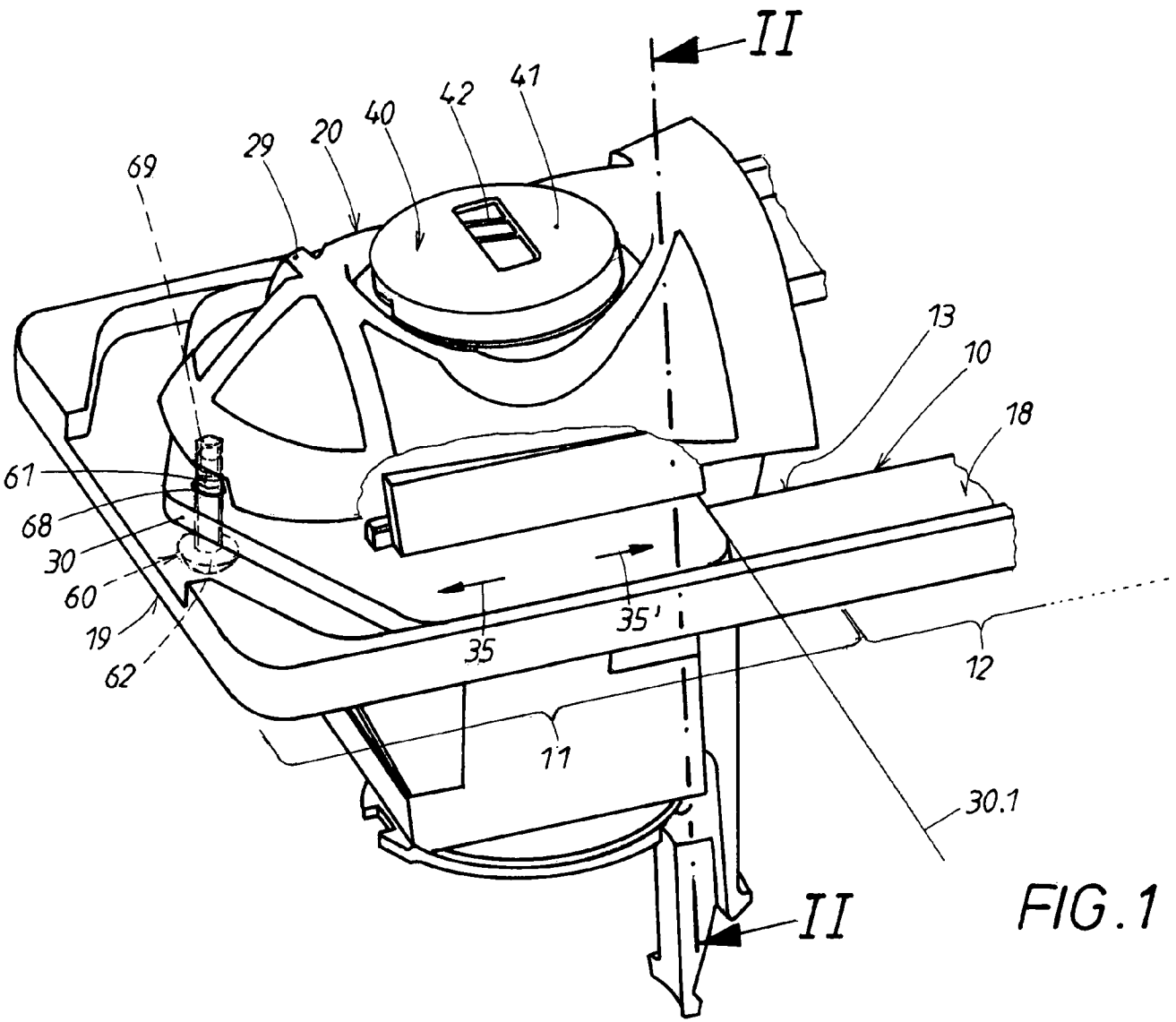
FIG. 1 is a perspective view of part of the fully installed actuating device according to the invention, wherein both the adjacent part with the handle and the outer door panel have been omitted.

The actuating device according to the invention includes, first, a carrier 10, which is attached to the inside of the door. At one end 11 of the carrier 10, a so-called "turret" 20 is mounted, which contains, for example, a lock cylinder 40. The adjacent area 12 of the carrier 10 serves to hold the handle of the device, not shown. A handle of this type and the lock cylinder 40 work together in the conventional manner with a lock provided in the door. As will be explained later in greater detail on the basis of FIGS. 5 and 6, the turret 20 is inserted afterwards from the outside of the door in the direction of the arrow 28 into an opening 13 in the carrier, which has already been mounted in the door. The insertion movement 28 is essentially perpendicular to the carrier 10. The handle is usually also mounted afterwards on the carrier 10, namely, before the insertion 28 of the turret 20.

Figure 2:
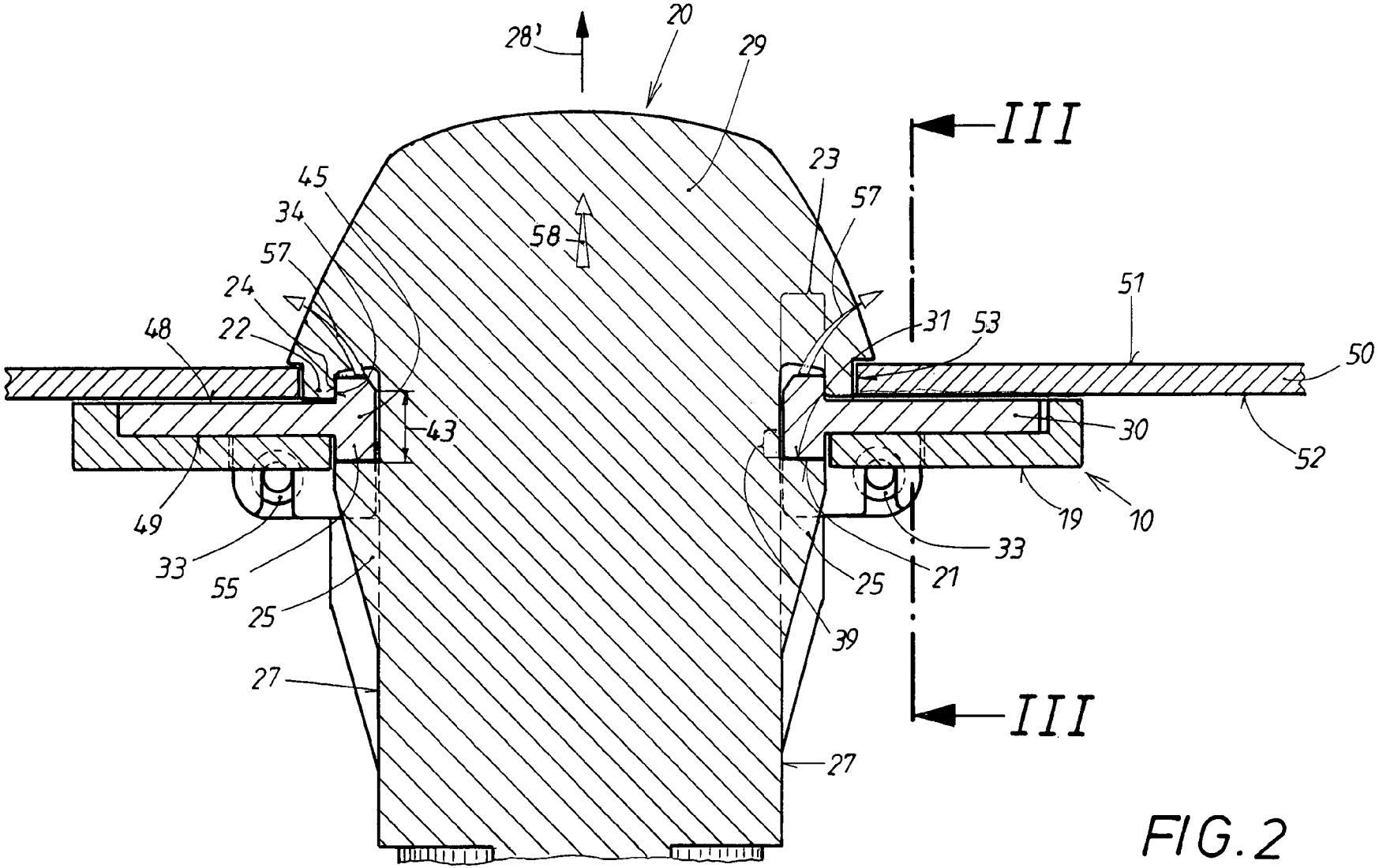
FIG. 2 is a schematic cross section through the fully installed actuating device of FIG. 1 along the line II-II in FIG. 1, although the outer door panel is shown here.

The completely inserted position of the turret 20 in the carrier 10 is shown in FIGS. 1 and 2. FIG. 2 also shows an exterior panel 50 of the door. In the exterior panel 50 there is a suitable opening 53 for the installation of the turret 20 and the handle. In the inserted position, the expanded head 29 of the turret comes to rest against the outside surface 51 of the panel 50, whereas the carrier 10 comes to rest against the inside surface 52. In FIG. 1, the exterior panel 50 has been omitted. A cap 41 of the lock cylinder 40 also comes to rest against the outside surface of the door. Access 42 to the lock cylinder inside the turret 40 is provided in the cap for a key, which belongs to the lock cylinder but which is not shown. This lock cylinder could also be omitted, which is usually the case on the rear doors of a vehicle. In that case, a dummy part similar to the illustrated turret is used, for which reason the following description is also applicable to this second embodiment. As can be seen especially clearly in FIG. 5, a slide 30 rests on the top surface 18 of the carrier 10. The carrier 10 is designed in the form of a plate at least in the area of the slide and has guide edges 17 along both sides, between which the slide can shift longitudinally in the direction of the arrows 35, 35'. The slide 30 has a cut-out area 36, which is aligned at least in certain cases with the opening 13 in the carrier 10 and thus allows the insertion 28 of the turret into the carrier-slide unit 10, 30. Edge strips 37, the outer longitudinal edges of which slide along the guide edges 27 during the movement 35, 35' of the slide, are present on both sides of the cut-out area 36. After insertion, the preliminary stage of which is shown in FIG. 6, the opposite inner longitudinal edges 38 of these edge strips 37 face the associated side walls 27 of the turret 20.

The slide 30 serves to lock the turret 20 in the carrier 10 after insertion, as shown in FIGS. 1 and 2. The slide can move between the locking position of FIG. 1, marked there by the auxiliary line 30.1, into a release position, shown in FIG. 6, indicated by the auxiliary line 30.2. In the locking position 30.1, as can be seen FIG. 2, four shoulders 31 of the slide 30 come to rest in front—relative to the pull-out direction 28'—of four opposing shoulders 21 on the two side walls 37 of the turret 20. It is advisable for at least these parts of the slide to be provided with thickened areas 39. In the illustrated embodiment, the thickened areas 39 are designed as blocks 55, 56, which project axially from the bottom surface 49 of the slide 30. In the release position 30.2 of FIG. 6, the shoulders 31 (not shown in detail) are pushed so far in the shift direction 35 that the opposing shoulders 21 provided on the turret 20 are released. Then the turret, as described, can be not only inserted in the direction of the arrow 28 but also pulled back out again in the direction of the arrow 28'.

Figure 4:
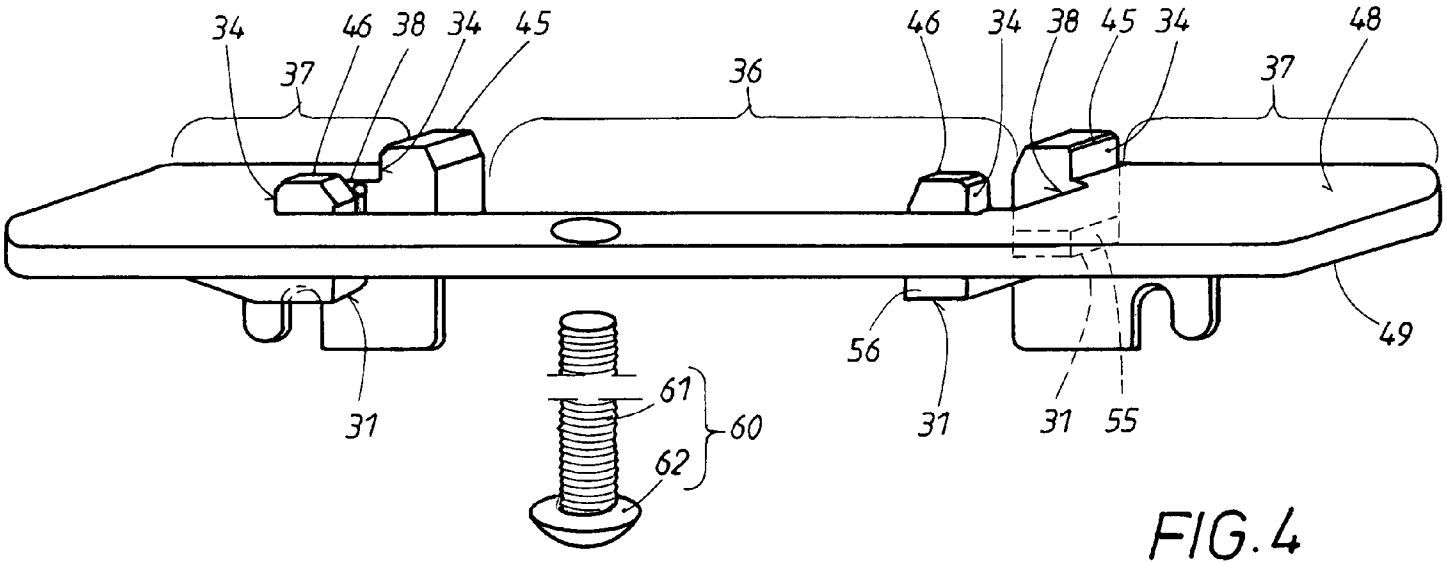
FIG. 4 is a perspective view of a component of the actuating device, namely, of a slide.
Figure 5:
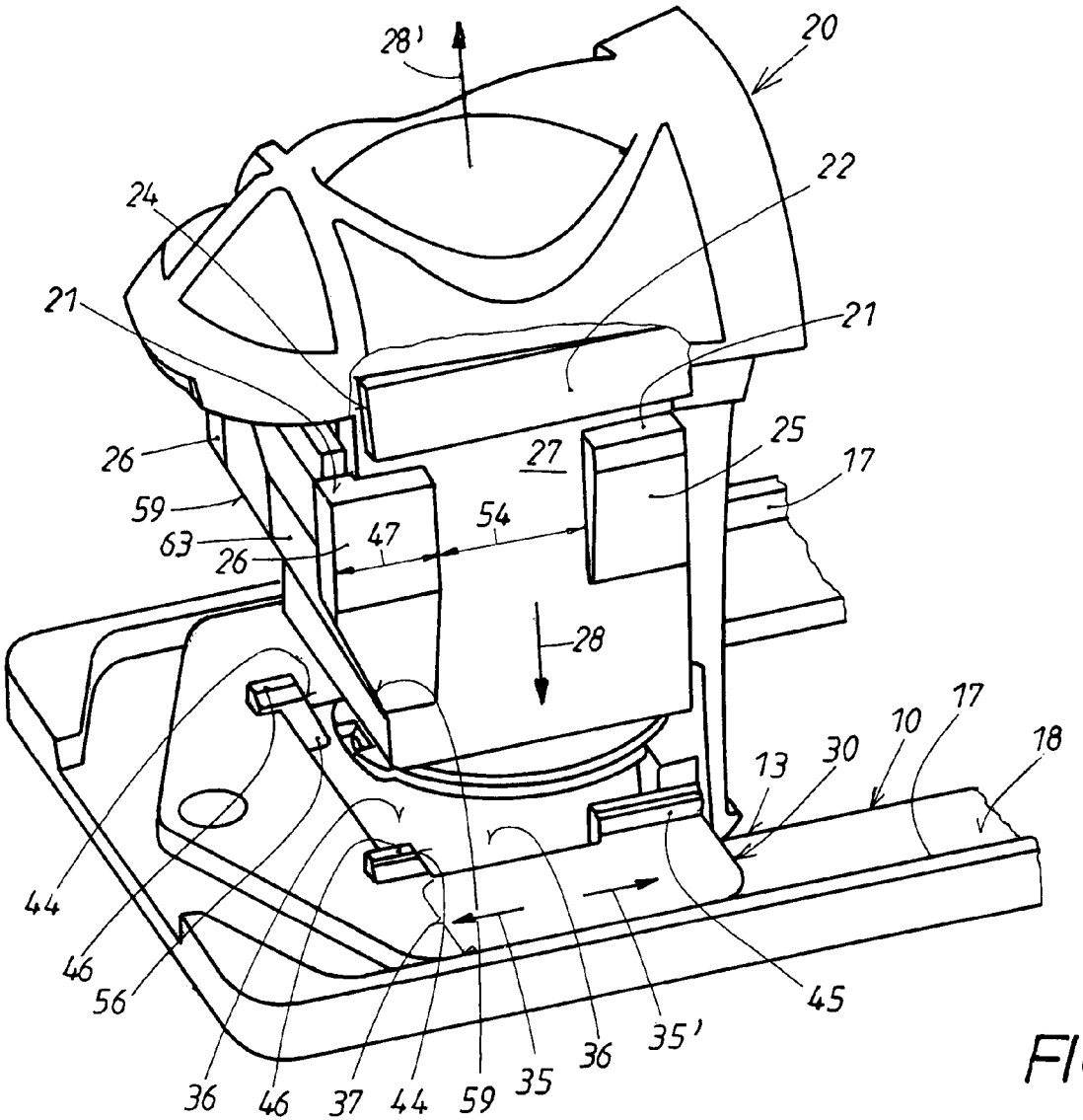
FIG. 5 is a view, from the same perspective as that of FIG. 1, of two components of the device in a first phase of their assembly.
Figure 6:
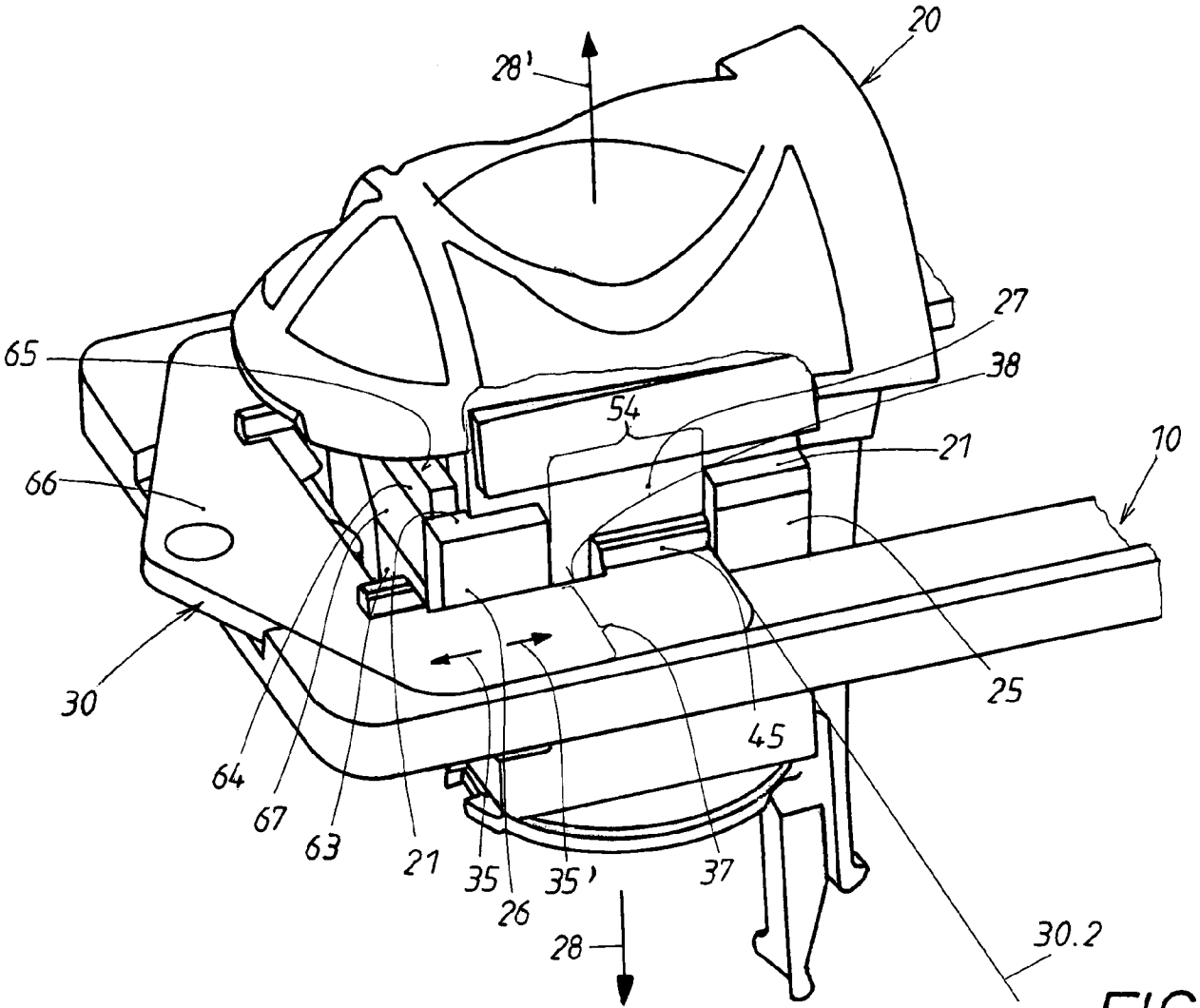
FIG. 6 shows a further phase of this assembly process, the result of which is the final state of the device shown in FIG. 1.

As can be seen in FIGS. 4 and 5, two of the previously mentioned opposing shoulders 21 are provided on each side wall 27 of the turret 20, these shoulders being formed by two radial projections 25, 26 on the side wall 27, namely, by the axial heels pointing in the pull-out direction 28'. Because the one radial projection 25 is closer to the handle than the other projection 26, the first is called the "leading" projection 25 and the other the "trailing" projection 26.

In a corresponding manner, the slide 30 also has lobes 45, 46 for the previously described shoulders 31, two of these lobes being provided on each of the two inner longitudinal edges 38 of the slide. At the location of the two lobes 45, 46, two blocks 55, 56 are also provided, as can be seen in FIG. 4. In a manner similar to that used for the radial projections 25, 26 of the turret 20, the lobe 25 and the block 55 closer to the handle are called the "leading" lobe and the "leading" block, whereas the others are called the "trailing" lobe and the "trailing" block.

An unauthorized person who wants to break into the vehicle will try to pull out the turret 20, which is locked in the carrier 10, in the direction of the arrow 28' of FIG. 2 in order to gain access to the door lock. To do this, the person will exert the pull-out force illustrated by the force arrow 58. The leading lobe 45 and the trailing lobe 46 on the top 48 of the slide 30, which point in the pull-out direction 28', allow the device to withstand high pull-out forces 58. In the present case, a common opposing lobe 22 on the turret is assigned to these two lobes 45, 46; this opposing lobe is a certain radial distance 23 away from the adjacent circumferential zone, i.e., from the previously mentioned side wall 27 of the turret 20. Because of this gap 23, there is a free space present between the circumferential zone, i.e., the side wall 27, and the radially inner surface 24 facing it. When the device is moved into the locking position 30.1, the leading lobe 45 and the trailing lobe 46 arrive in this free space. Then a radially outer surface 34 of a lobe 45, 46 comes to rest against the radially inner surface 24 of the opposing lobe 22.

Pull-out forces 58 acting on the turret 20 are transmitted from the opposing shoulders 21 of the projections 25, 26 on both sides via the shoulders 31 and the associated blocks 55, 56 to the slide 30. As can be seen in FIG. 2, this has the effect of producing the bending forces 57, which act on the slide 30; these forces try to bend the slide 30 upward until the turret and its two radial projections 25, 26 can be pulled out in the direction of the arrow 28'. The invention makes this impossible, however, because the previously mentioned radially outer surfaces 34 of the lobes 45, 46 are supported against the assigned radially inner surfaces 24 of the opposing lobe 22 and thus absorb these bending forces 57 and transmit them back to the turret 20. For this reason, the inventive actuating device can withstand surprisingly high pull-out forces 58.

The opposing lobe 22 is produced in the form of a continuous strip. This opposing lobe strip 22 is not only a certain radial distance 23 away from the associated side wall 27 of the turret 20 but also, as FIG. 2 shows, a certain axial distance 43 away from the heel surfaces of the two radial projections 25, 26, which produce the opposing shoulder 21, this axial distance being such that the profile of the slide 30 fits between the two lobes. According to FIG. 5, the opposing lobe strip extends over the entire length of the leading lobe 25 but over only a part of the opposing shoulder 21 of the trailing projection 26. It is also worth observing that the distance 54 visible in FIG. 5 between the two radial projections 25, 26 is greater, at most equal to, the length 47 of the trailing lobe 46. This is especially clear in FIG. 6, which will be discussed in greater detail below.

Figure 3:
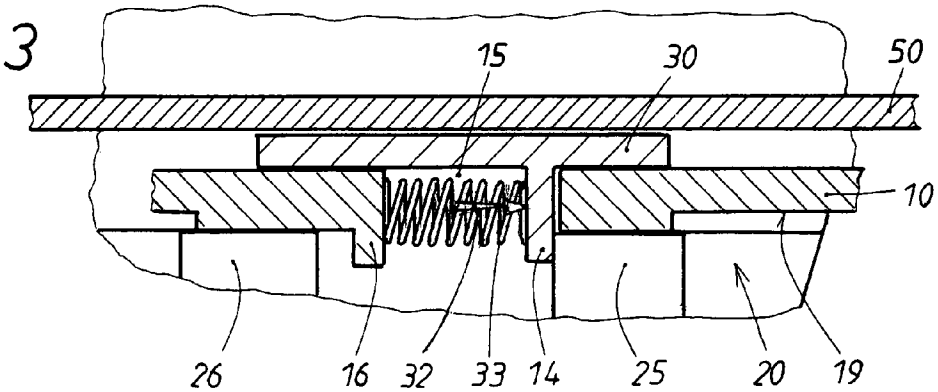
FIG. 3 shows a detail of FIG. 2 in the direction of the cross-sectional plane of the device indicated by sectional line III-III.

The slide 30 is usually located in the locking position 30.1 shown in FIG. 1. This is ensured by a spring-loading device 32, acting between the slide 30 and the carrier 10. The arrangement and function of this spring device is especially easy to see in FIG. 3. This is achieved by two compression springs 33, which are located on opposite sides of the turret 20, as can be seen in FIG. 2. The slide 30 is provided with an axially projecting tab 14, which passes through a slot 15 in the carrier. The carrier 10 has for its own part a tongue 16 projecting from its bottom surface 19. A compression spring 33 is positioned between the tab 14 and the tongue 16 in each case.

The turret 20 has a control surface 59, extending at a slant to the insertion direction 28. There are two of these control surfaces 59, one on each of the wide sides 63 of the turret 20, and they represent components of the trailing projections 26 on both sides. Actuating-surfaces 44 on the slide 30, which have the opposite slant, cooperate with these control surfaces 59. As can be seen in FIG. 4, these actuating surfaces 44 are components of the two trailing lobes 46, i.e., trailing blocks 56, on both sides of the slide cutout 36. When the turret is inserted in the direction 28, the two control surfaces 59 meet the actuating surfaces 44 and push the slide 30 back in the direction of the arrow 35 of FIG. 5. This backward shift 35 proceeds in opposition to the force of the spring-loading device 32.

The extent of this backward shift 35 can be seen in FIG. 6, where, as already mentioned, the slide 30 has reached its release position 30.2. Because of the backward movement 35 of the slide, the leading lobes 45 on the two sides and the associated leading blocks 55 become aligned with the intermediate space 54 between the two radial projections 25, 26 belonging to the turret and travel into it over the further course of the insertion movement 28 until they reach the level of the axial heels 21. Then the slide 30, i.e., its leading lobe 45 and leading block 55, is no longer supported against the sidepiece of the turret-side leading projection 25. Under the action of the spring-loading device 32, the slide 30 is then pushed in the direction of the arrow 35' shown in FIGS. 6 and 5, as a result of which the locking position 30.1 of the slide 30 of FIG. 1 is finally reached again automatically. The turret 20 is then arrested permanently in the carrier 10 in the previously described manner.

As can be derived from FIG. 6, the turret 20 has a transverse rib 64 on its wide side 63. This rib extends between the two turret side walls 27 and is provided with a contact surface 65 facing in the pull-out direction 28'. The two edge strips 37 of the slide 30 are connected to each other by a terminal web 66. To arrive in the locking position 30.1, the terminal web 66 of the slide 30 travels across the contact surface 65 of the turret during the previously described forward movement 35'. Axially below the contact surface 65, the transverse rib 64 can have a slanted surface 67, which proceeds at a slant with respect to the insertion direction 28 of the turret 20.

To secure the locking position 30.1, a lock screw 60 is provided, which, as can be seen in FIG. 4, consists of a shaft 51 and a head 62, which can be actuated by a screwdriver. The head 62 is accessible from the bottom surface 19 of the carrier 10, which also has a hole to accept the shaft 61. Once the locking position 30.1 has been reached, the shaft end of the screw 60 is aligned with a hole 68 in the terminal web 66 of the slide 30. When the lock screw 60 is inserted, the shaft end enters the hole 68 and can pushed in as far as a threaded bore 69 in the head 29 of the turret 20. The screw 60 can then be tightened in this bore.

While specific embodiments of the invention have been shown and described in detail to illustrate the inventive principles, it will be understood that the invention may be embodied otherwise without departing from such principles.

We claim:

1. An actuating device for a door or hatch of a vehicle, comprising a carrier, adapted to be attached to an inside of the door or hatch;

a turret, which can be inserted into an opening in the carrier and which has either a lock cylinder or a dummy cylinder for the sake of styling;

a slide, which is guided with freedom of longitudinal movement in the carrier and which has a cut-out area which encloses at least a certain part of the inserted turret;

wherein at least one shoulder is provided on the slide and an opposing shoulder is provided on the turret;

wherein the slide can be shifted with respect to the turret between a locking position and a release position;

and wherein, when the slide is in the locking position, the shoulder of the slide projects over the opposing shoulder and thus locks the turret in an inserted position in the carrier opening;

whereas, when the slide is in the release position, the shoulder releases the opposing shoulder and allows the turret to be inserted into the carrier or pulled back out of it, wherein the slide has at least one lobe on a top surface thereof pointing in the pull-out direction, which lobe has a radially outer surface pointing away from the inserted turret;

the turret having an opposing lobe pointing in the insertion direction, which is a certain radial distance away from an adjacent circumferential zone of the turret and which has a radially inner surface facing the turret; and wherein, when the slide is moved into the locking position, its lobe travels into a radial gap in the turret and thus assumes a position behind the opposing lobe on the inserted turret, where the radially outer surface of the lobe on the slide is supported against the radially inner surface of the opposing lobe, wherein, below the circumferential zone with the opposing lobe, the turret has at least one radial projection;

the radial projection has an axial heel oriented toward this circumferential zone; and this axial heel produces the opposing shoulder which cooperates with the slide.

2. The actuating device according to claim 1, wherein the plate-shaped slide has a thickened part in the area of its shoulder, wherein, in the locking position, the shoulder is located in front of the opposing shoulder.

3. The actuating device according to claim 2, wherein the thickened part is comprised of a block which is mounted on a bottom surface of the plate-shaped slide.

4. The actuating device according to claim 3, wherein the lobe on the top and the block on the bottom are mounted at essentially the same point on the slide.

5. The actuating device according to claim 3, wherein the lobes and/or the blocks are located on the inner longitudinal edges of the slide-next to the two long sides of the cut-out area.

6. The actuating device according to claim 5, wherein two lobes and/or blocks, which are a certain distance apart in the direction in which the slide moves, are located on the inner longitudinal edge of the slide.

7. The actuating device according to claim 6, wherein the one lobe and/or block is located in a area of a beginning of the cut-out area, which is the area closer to a handle, and thus represents the leading lobe or leading block, whereas the other lobe and/or block is positioned in the area at the end of the cut-out area farther away from the handle and thus represents the trailing lobe or block.

8. The actuating device according to claim 6, wherein the leading lobe and the trailing lobe of the slide are assigned to a common opposing lobe on the turret.

9. The actuating device according to claim 8, wherein the common opposing lobe consists of a continuous strip.

10. The actuating device according to claims 6, wherein two radial projections are located on the side wall of the turret; and the two radial projections are a certain distance apart in the direction of movement of the slide, and, after the turret has been inserted, form a leading projection facing the handle and a trailing projection farther away from the handle.

11. The actuating device according to claim 10, wherein, in the locking position, the leading projection of the turret is aligned with the leading lobe or leading block of the slide; and the trailing projection of the turret lines up with the trailing lobe or trailing block of the slide.

12. The actuating device according to claim 10, wherein the leading projection and the trailing projection are assigned to a common opposing lobe strip; and the opposing lobe strip is located a certain axial distance away from the two axial heels of the two radial projections which form the opposing shoulder.

13. The actuating device according to claim 12, wherein the continuous opposing lobe strip covers essentially the entire opposing shoulder of the leading projection but only a part of the opposing shoulder of the trailing projection.

14. The actuating device according to claim 10, wherein the distance between the two radial projections is greater than or equal to the length of the trailing lobe or trailing block of the slide.

15. The actuating device according to claim 1, wherein the radial projections are located on opposite side walls of the turret, wherein, after the turret has been inserted and is in the locking position, the side walls of the turret face the inner longitudinal edges of the slide.

16. The actuating device according to claim 1, wherein the turret has at least one control surface extending at a slant to the insertion direction;

wherein the slide has an actuating surface, which has a slant opposite that of the control surface; and wherein, upon insertion, the control surface of the turret meets the actuating surface and pushes the slide automatically back out of its locking position into the release position.

17. The actuating device according to claim 16, wherein the control surface is located on the radial projection of the turret; and the actuating surface is on the lobe and/or on the block.

18. The actuating device according to claim 17, wherein the control surface is seated on a wide side of the radial projection and, with respect to the insertion direction of the turret, axially precedes the radial projection's axial heel.

19. The actuating device according to claim 1, wherein, on the wide side of the turret extending between the two side walls of the turret, a transverse rib is located, which has a contact surface pointing in the pull-out direction of the turret;

the cut-out area of the slide is bounded by a terminal web; and in that to arrive in the locking position, the terminal web of the slide travels across the contact surface of the transverse rib of the turret.

20. The actuating device according to claim 19, wherein the transverse rib has a slanted surface axially below the contact surface; and the slanted surface is at a slant to the insertion direction of the turret.

21. The actuating device according to claim 1, wherein spring-loading device is provided between the slide and the carrier; and the spring-loading device tries to push the slide into its locking position.

22. The actuating device according to claim 21, wherein the spring-loading device is formed by two compression springs; and, after the turret has been inserted, the two compression springs are located on opposite side walls of the turret.

23. The actuating device according to claim 22, wherein the slide has an axially projecting tab;

the tab passes through a slot in the carrier and projects from the bottom surface of the carrier;

the carrier has a tongue on its bottom surface, which is aligned with the tab; and the compression spring is supported between the tongue and the tab.

24. The actuating device according to claim 1, wherein the carrier is a plate at least in the area of the opening which allows the turret to be inserted; and the plate-shaped slide rests on the top surface of the carrier, which is the surface which faces in the pull-out direction of the turret.

25. The actuating device according to claim 24, wherein the carrier has side edges on its top surface, between which the slide is seated; and the slide travels between the guide edges when it shifts position.

26. The actuating device according to claim 1, wherein a lock screw is provided, which lock screw secures the locking position of the slide with respect to the carrier and/or the turret.

27. The actuating device according to claim 26, wherein the carrier has a threaded hole for the lock screw;

the one end of the lock screw allows the screw to be turned, whereas another end functions the shaft of the lock screw is aligned with a hole in the slide when the slide is in the locking position; and, when the lock screw is turned when the slide is in the locking position, the screw travels into the hole and secures the slide.

28. The actuating device according to claim 26, wherein the shaft of the screw passing through the hole in the slide is configured to be screwed into a threaded bore in the turret.

29. The actuating device according to claims 26, wherein the head of the lock screw is on the bottom surface of the carrier.

* * * * *

UNITED STATES PATENT AND TRADEMARK OFFICE

CERTIFICATE OF CORRECTION

PATENT NO. : 7,260,964 B2
APPLICATION NO. : 11/016541
DATED : August 28, 2007
INVENTOR(S) : Mensur Velicanin et al.

It is certified that error appears in the above-identified patent and that said Letters Patent is hereby corrected as shown below:

Title Page - should read
(73) Assignee: Huf Hülsbeck & Fürst GmbH & Co. KG,
Velbert (DE)

Signed and Sealed this

Twenty-seventh Day of November, 2007

JON W. DUDAS
*Director of the United States Patent and Trademark Office*